US009982635B2

(12) United States Patent
Wakamatsu et al.

(10) Patent No.: US 9,982,635 B2
(45) Date of Patent: May 29, 2018

(54) VAPORIZED FUEL TREATING DEVICE AND BLOW-BY GAS RETURNING DEVICE

(71) Applicant: AISAN KOGYO KABUSHIKI KAISHA, Obu-shi, Aichi-ken (JP)

(72) Inventors: Keisuke Wakamatsu, Anjo (JP); Rui Onoda, Gamagori (JP); Katsuhiko Makino, Aichi-ken (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 15 days.

(21) Appl. No.: 14/978,973

(22) Filed: Dec. 22, 2015

(65) Prior Publication Data

US 2016/0186694 A1 Jun. 30, 2016

(30) Foreign Application Priority Data

Dec. 25, 2014 (JP) ..... 2014-262803

(51) Int. Cl.
*F02M 25/08* (2006.01)
*F02M 35/10* (2006.01)
*F01M 13/02* (2006.01)

(52) U.S. Cl.
CPC ..... *F02M 25/08* (2013.01); *F01M 13/021* (2013.01); *F01M 13/022* (2013.01); *F02M 25/0836* (2013.01); *F02M 35/10222* (2013.01); *F01M 2013/027* (2013.01)

(58) Field of Classification Search
CPC .... F02M 25/08; F02M 25/0836; F02M 35/10; F02M 35/10222; F01M 13/02; F01M 13/021; F01M 2013/027
USPC ..... 123/518–521, 457, 458, 684, 559.1; 701/100, 101, 113
See application file for complete search history.

(56) References Cited

U.S. PATENT DOCUMENTS 8,991,365 B2 3/2015 Konohara
9,163,590 B2 10/2015 Takeishi et al.
2012/0247438 A1* 10/2012 Konohara ..... F01M 13/022 123/559.1

(Continued)

FOREIGN PATENT DOCUMENTS

JP 2009-133292 A 6/2009
JP 2009180095 A * 8/2009

(Continued)

OTHER PUBLICATIONS

Jp 2009 108095 English Translation Version.*

*Primary Examiner* — John Kwon
*Assistant Examiner* — Johnny H Hoang
(74) *Attorney, Agent, or Firm* — Conley Rose, P.C.

(57) ABSTRACT

A combination of a vaporized fuel treating device and a blow-by gas returning device for an engine having a forced induction device may include an ejector. The ejector is disposed in a bypass passage that is in communication with an intake conduit at portions positioned upstream and downstream of the forced induction device. The ejector is configured to receive a boost gas generated by the forced induction device and to generate negative pressures therein, so as to supply the generated negative pressures to a purge conduit of the vaporized fuel treating device and a blow-by gas returning conduit of the blow-by gas returning device.

19 Claims, 8 Drawing Sheets

(56) References Cited

U.S. PATENT DOCUMENTS

| | | | | |
|---|---|---|---|---|
| 2013/0199504 | A1* | 8/2013 | Takeishi | F02M 25/0809 123/520 |
| 2013/0213369 | A1* | 8/2013 | Doko | F01M 13/023 123/574 |
| 2014/0096750 | A1* | 4/2014 | Pearce | F02M 25/0818 123/520 |
| 2014/0251285 | A1* | 9/2014 | Surnilla | F02B 47/08 123/520 |
| 2015/0292421 | A1* | 10/2015 | Pursifull | F02D 41/004 123/518 |
| 2016/0040688 | A1† | 2/2016 | Fletcher | |
| 2016/0153328 | A1† | 6/2016 | Fletcher | |

FOREIGN PATENT DOCUMENTS

| | | | |
|---|---|---|---|
| JP | 2012-184755 | A | 9/2012 |
| JP | 2012-215155 | A | 11/2012 |
| JP | 2013-160108 | A | 8/2013 |
| JP | 2013-227901 | A | 11/2013 |
| JP | 2014-122567 | A | 7/2014 |

* cited by examiner
† cited by third party

VAPORIZED FUEL TREATING DEVICE AND BLOW-BY GAS RETURNING DEVICE

CROSS-REFERENCE TO RELATED APPLICATIONS

This application is based upon and claims priority to Japanese Patent Application Serial No. 2014-262803 filed on Dec. 25, 2014, the contents of which are incorporated herein by reference in their entirety for all purposes.

STATEMENT REGARDING FEDERALLY SPONSORED RESEARCH OR DEVELOPMENT

Not applicable.

BACKGROUND

The present disclosure relates to a vaporized fuel treating device and a blow-by gas returning device for a forced induction (e.g., supercharged, turbocharged, etc.) engine. More particularly, the present disclosure relates to a combination of a vaporized fuel treating device and a blow-by gas returning device for a supercharged engine. The vaporized fuel treating device is configured to adsorb vaporized fuel from a fuel tank to a canister through a vapor conduit, and feed the adsorbed vaporized fuel to the engine through a purge conduit so as to purge the adsorbed vaporized fuel from the canister. Conversely, the blow-by gas returning device is configured to return gas (e.g., blow-by gas, etc.) leaked from combustion chambers of the engine to the combustion chambers through a blow-by gas returning conduit.

A vaporized fuel treating device for a supercharged engine is taught by, for example, JP2013-160108A. The device is configured to generate a negative pressure in an ejector using a boost (supercharging) pressure from a supercharger, and to purge a canister via the negative pressure generated in the ejector. Conversely, a blow-by gas returning device for a supercharged engine is taught by, for example, JP2012-215155A. The device disclosed therein is configured to generate a negative pressure in an ejector using a boost pressure from a supercharger, and to return a blow-by gas to the engine via the negative pressure generated in the ejector.

The vaporized fuel treating device and the blow-by gas returning device discussed above can be used in combination in a supercharged engine. However, when both of the vaporized fuel treating device and the blow-by gas returning device are used in conjunction with a supercharged engine, an engine system of the supercharged engine may be overly complicated given that the vaporized fuel treating device and the blow-by gas returning device respectively have the ejectors.

Thus, there is a need in the art for an improved vaporized fuel treating device and an improved blow-by gas returning device for a forced induction engine.

SUMMARY

For example, one aspect of the present disclosure may provide a combination of a vaporized fuel treating device and a blow-by gas returning device for an engine having a forced induction device (e.g., turbocharger, supercharger, etc.), wherein the vaporized fuel treating device is configured to adsorb vaporized fuel from a fuel tank to a canister through a vapor conduit and to feed the adsorbed vaporized fuel to the engine through a purge conduit so as to purge the adsorbed vaporized fuel from the canister, and wherein the blow-by gas returning device is configured to return gas leaked from combustion chambers of the engine to the combustion chambers through a blow-by gas returning conduit, which may include an ejector disposed in a bypass passage that is in communication with an intake conduit at portions positioned upstream and downstream of the forced induction device, wherein the ejector is configured to receive a boost gas generated by the forced induction device and to generate negative pressures therein, so as to supply the generated negative pressures to the purge conduit and the blow-by gas returning conduit.

According to one aspect of the disclosure, no special ejector may be required for each of the vaporized fuel treating device and the blow-by gas returning device in order to purge the adsorbed vaporized fuel from the canister and return the gas leaked from the combustion chambers of the engine. As a result, an engine system having the vaporized fuel treating device and the blow-by gas returning device may be simplified.

Optionally, the ejector may be a multi-stage ejector having a plurality of inlet ports in which the negative pressures are generated. Further, a first inlet port in which a relatively high negative pressure is generated may be connected to the purge conduit, and a second inlet port in which a relatively low negative pressure is generated may be connected to the blow-by gas returning conduit.

Further, the purge conduit may have a purge control valve that is configured to control a flow rate of air flowing through the purge conduit.

Further, the combination may include a boost pressure control device that is configured to control the forced induction device such that a boost pressure supplied to the ejector equals or exceeds a pressure required to activate the ejector.

Further, the combination may include a pressure sensor disposed in the bypass passage, and the boost pressure control device may be configured to control the forced induction device based on a pressure detected by the pressure sensor.

Other objects, features, and advantages, of the present disclosure will be readily understood after reading the following detailed description together with the accompanying drawings and the claims.

DETAILED DESCRIPTION OF THE DISCLOSURE

Detailed representative embodiments of the present disclosure are shown in FIG. 1 to FIG. 9.

A first detailed representative embodiment of the present disclosure is described with reference to FIGS. 1 to 5.

Figure 1:
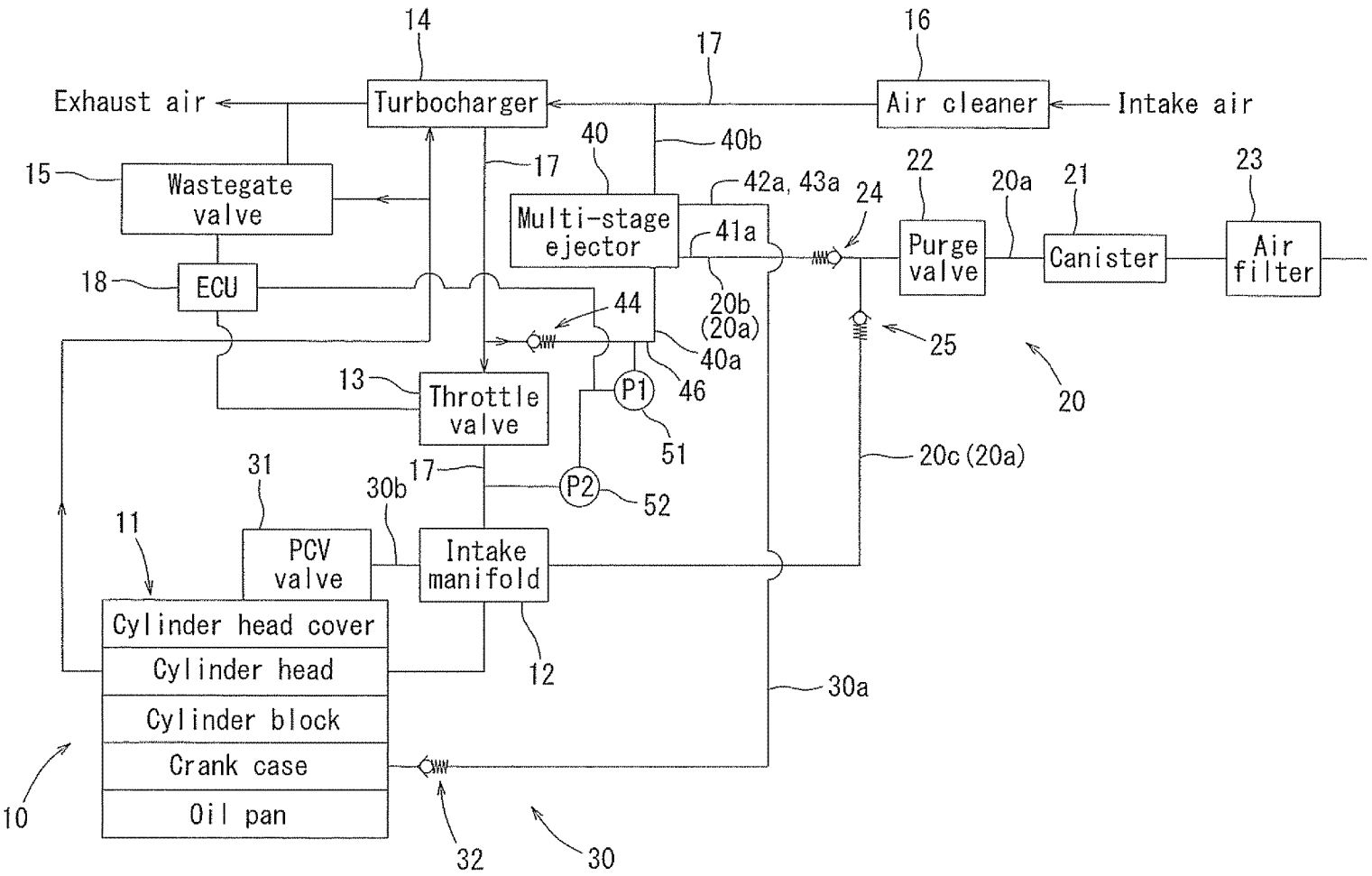
FIG. 1 is a block diagram of an engine system including a vaporized fuel treating device and a blow-by gas returning device according to a first embodiment of the present disclosure.

As shown in FIG. 1, this embodiment of the present disclosure may be directed to an engine system 10 of a vehicle having a forced induction (e.g., turbocharged, supercharged, etc.) engine unit 11 (which will be hereinafter referred to as an engine 11). In certain embodiments, the engine system 10 includes a vaporized fuel treating device 20, a blow-by gas returning device 30, and a common ejector or multi-stage ejector 40. In this embodiment, multi-stage ejector 40 comprises a three-stage ejector; however, in other embodiments, multi-stage ejector 40 comprises varying stages. Further, in the following description, "upstream" and "downstream" may respectively be defined with reference to a flow direction of air or vaporized fuel flowing through the engine system 10. Further, in certain embodiments, the vaporized fuel includes fuel vapor generated while filling and fuel vapor generated by fuel vaporization in a fuel tank (not shown).

The engine system 10 may have a known basic structure. That is, as shown in FIG. 1, the engine system 10 may be configured such that an air-fuel mixture is supplied to the engine 11 through an intake manifold 12 (which may be referred to as an intake passage) and communicated with an intake conduit 17 positioned upstream thereof. Further, in some embodiments, the intake conduit 17 includes an air cleaner 16, a forced induction device 14 and throttle valves 13 positioned from upstream to downstream. In this embodiment, forced induction device 14 comprises a turbocharger 14; however, in other embodiments, forced induction device 14 may comprise other mechanisms configured for providing forced induction, such as superchargers and the like.

In particular, air may be fed to the intake manifold 12 of engine 11 while an amount thereof is controlled by the throttle valves 13. Conversely, fuel may be fed to the intake manifold 12 via fuel injection valves (not shown) while a flow rate thereof is controlled. In some embodiments, the throttle valves 13 and the fuel injection valves are respectively be connected to an engine control unit (ECU) 18. In certain embodiments, the throttle valves 13 transmit signals representative of valve opening amounts or valve positions of the throttle valves 13 to the ECU 18, so that the ECU 18 can control valve opening times of the fuel injection valves.

As is well known, the turbocharger 14 may have a wastegate valve 15. In some embodiments, the wastegate valve 15 is be configured to control an amount of exhaust gas emitted from the engine 11 and fed to a turbine of the turbocharger 14 by opening and closing thereof, so as to control (increase and reduce) a boost pressure (boost gas) generated by a compressor of the turbocharger 14. For example, when the boost pressure is excessively supplied to the engine 11, the wastegate valve 15 may be opened in order to prevent the engine 11 and a turbine of the turbocharger 14 from being damaged.

In certain embodiments, the vaporized fuel treating device 20 is configured such that the vaporized fuel is adsorbed to a canister 21. The adsorbed vaporized fuel may then be purged from the canister 21 so as to be fed to the intake passage (i.e., the intake manifold 12) of the engine 11 through a purge conduit 20*a*. As shown in FIG. 1, in certain embodiments, the purge conduit 20*a* includes an air filter 23 and a vacuum switching valve (VSV) or purge (control) valve 22 that are respectively positioned upstream and downstream of the canister 21. As will be recognized, the air filter 23 may function to filtrate air introduced into the purge conduit 20*a*. Conversely, in some embodiments, the purge valve 22 comprises a duty control solenoid valve that is capable of substantially controlling a purge flow rate, i.e., a flow rate of air containing the vaporized fuel purged from the canister 21. Further, the purge valve 22 (solenoid valve) may be replaced with another valve that is capable of continuously or intermittently controlling the purge flow rate (the flow rate of air).

In some embodiments, the purge conduit 20*a* branches to a first conduit 20*b* and a second conduit 20*c* downstream of the purge valve 22. The first conduit 20*b* may be connected to a first inlet port 41*a* of the multi-stage ejector 40 (which will be hereinafter described). Conversely, the second conduit 20*c* may be connected to the intake manifold 12. In some embodiments, the first conduit 20*b* and the second conduit 20*c* respectively include check valves 24 and 25 that are respectively positioned therein. The check valves 24 and 25 may respectively be configured to allow the vaporized fuel to flow from the purge valve 22 to the multi-stage ejector 40 and the intake manifold 12 and to prevent a reverse flow.

In certain embodiments, the blow-by gas returning device 30 is be configured to return blow-by gas (i.e., fuel gas leaked from combustion chambers formed between a cylinder block and a cylinder head of the engine 11, and accumulated within a cylinder head cover of the engine 11) to the engine 11 (the combustion chambers) through the intake manifold 12. As shown in FIG. 1, in certain embodiments, the blow-by gas returning device 30 includes a first blow-by gas returning conduit 30*a* (which may be simply referred to as a blow-by gas returning conduit) and a second blow-by gas returning conduit 30*b*. Fluid communication between the cylinder head cover of the engine 11 and the intake manifold 12 may be provided via the second blow-by gas returning conduit 30*b*. In some embodiments, the second blow-by gas returning conduit 30*b* includes a check valve or PCV (positive crankcase ventilation) valve 31 that is positioned therein. The PCV valve 31 may be configured to allow a flow of air from the cylinder head cover of engine 11 to the intake manifold 12, and to prevent a reverse flow therebetween. Therefore, the blow-by gas accumulated within the cylinder head cover of the engine 11 can be returned to the combustion chambers of the engine 11 through the intake manifold 12.

The blow-by gas returning device 30 may also be configured to return blow-by gas (i.e., fuel gas leaked from the combustion chambers of the engine 11 and accumulated within a crankcase of the engine 11) to the engine 11 through the multi-stage ejector 40 and the intake manifold 12. As shown in FIG. 1, fluid communication between the crankcase of the engine 11 and a second inlet port 42*a* and a third inlet port 43*a* of the multi-stage ejector 40 may be provided via the first blow-by gas returning conduit 30*a*. The first blow-by gas returning conduit 30*a* may have a check valve 32 that is positioned therein. The check valve 32 may be configured to allow a flow of air from the engine 11 (the crankcase) to the multi-stage ejector 40 and to prevent a reverse flow therebetween.

Figure 2:
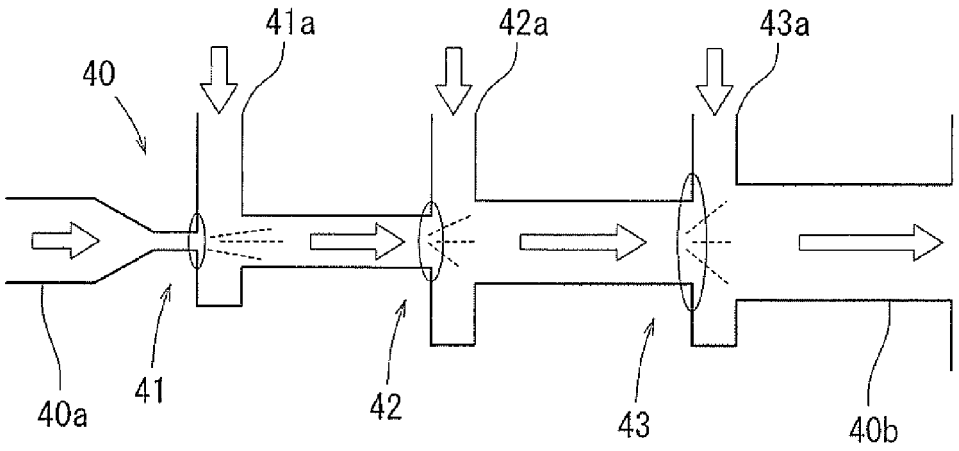
FIG. 2 is an explanatory, schematic view of an embodiment of a multi-stage ejector contained in the engine system.

The multi-stage ejector 40 may have a known basic structure. That is, as shown schematically in FIG. 2, in certain embodiments the multi-stage ejector 40 is composed of three (first stage, second stage and third stage) ejector elements 41, 42 and 43 positioned in series from upstream to downstream. In particular, a discharge port of the first stage ejector element 41 may be connected to a charge port of the second stage ejector element 42 while a discharge port of the second stage ejector element 42 may be connected to a charge port of the third stage ejector element 43. Further, a charge port of the first stage ejector element 41 and a discharge port of the third stage ejector element 43 may respectively function as a charge port 40*a* and a discharge port 40*b* of the multi-stage ejector 40. Further, ejector elements 41, 42 and 43 may have different nozzle diameters. In particular, as shown in FIG. 2, ejector elements 41, 42 and 43 may respectively have a small nozzle diameter, a middle nozzle diameter and a large nozzle diameter, respectively.

As shown in FIG. 1, the multi-stage ejector 40 thus constructed may be disposed in a bypass passage 46 that is in fluid communication with the intake conduit 17 at portions positioned upstream and downstream of the turbocharger 14. In particular, the charge port 40*a* of the multi-stage ejector 40 may be in fluid communication with the intake conduit 17 at the portion positioned downstream of the turbocharger 14. Conversely, the discharge port 40*b* of the multi-stage ejector 40 may be in fluid communication with the intake conduit 17 at the portion positioned upstream of the turbocharger 14. Further, in some embodiments, the bypass passage 46 includes a check valve 44 that is positioned therein. The check valve 44 may be positioned upstream of the multi-stage ejector 40. The check valve 44 may be configured to allow a flow of air from downstream to upstream of the turbocharger 14 and to prevent a reverse flow therebetween.

Further, the first to third inlet ports 41*a*, 42*a* and 43*a* of the multi-stage ejector 40 may respectively be formed in the first to third stage ejector elements 41, 42 and 43. As previously described, in the vaporized fuel treating device 20, the canister 21 may be in communication (e.g. fluid communication) with the first inlet port 41*a* of the multi-stage ejector 40 via the first conduit 20*b* of the purge conduit 20*a*. Conversely, in the blow-by gas returning device 30, the crankcase of the engine 11 may be in communication (e.g., fluid communication) with the second inlet port 42*a* and the third inlet port 43*a* of the multi-stage ejector 40 via the first blow-by gas returning conduit 30*a*. Therefore, the vaporized fuel adsorbed to the canister 21 of the vaporized fuel treating device 20 can be fed to the combustion chambers of the engine 11 through the multi-stage ejector 40 and the intake manifold 12. Further, the blow-by gas accumulated within the crankcase of the engine 11 can be returned to the combustion chambers of the engine 11 through the multi-stage ejector 40 and the intake manifold 12.

As shown in FIG. 1, in some embodiments the bypass passage 46 includes a first pressure sensor 51 positioned between the check valve 44 and the multi-stage ejector 40. Further, in some embodiments the intake conduit 17 includes a second pressure sensor 52 positioned between the throttle valves 13 and the intake manifold 12. The first and second pressure sensors 51 and 52 may respectively be configured to detect (air) pressures of corresponding portions in the bypass passage 46 and the intake conduit 17 and to send representative signals to the ECU 18.

Next, an operation of the engine system 10 including the vaporized fuel treating device 20 and the blow-by gas returning device 30 is described in detail.

Particularly, when the engine 11 is not supercharged by the turbocharger 14, a negative pressure may be generated in the intake manifold 12 positioned downstream of the throttle valve 13. At this time, in some embodiments the canister 21 is purged through the second conduit 20*c* of the purge conduit 20*a*, so that the vaporized fuel purged from the canister 21 may be fed to the engine 11 through the second conduit 20*c*. Conversely, the blow-by gas may be returned to the engine 11 through the second blow-by gas returning conduit 30*b*.

When the boost pressure of the turbocharger 14 is increased, the amount of the air flowing through the bypass passage 46 may be increased, so that desired negative pressures may respectively be generated in the first to third inlet ports 41*a*, 42*a* and 43*a* of the multi-stage ejector 40. The generated negative pressures may respectively be supplied to the purge conduit 20*a* and the first blow-by gas returning conduit 30*a* through the first to third inlet ports 41*a*, 42*a* and 43*a* of multi-stage ejector 40. As a result, the canister 21 may be purged through the first conduit 20*b* of the purge conduit 20*a* via the negative pressure in the first inlet port 41*a*. Conversely, in certain embodiments the blow-by gas is returned to the engine 11 through the first blow-by gas returning conduit 30*a* via the negative pressures in the second and third inlet ports 42*a* and 43*a*. At this time, a positive pressure may be generated in the intake manifold 12 positioned downstream of the throttle valve 13 due to the increased boost pressure of the turbocharger 14. Therefore, the second conduit 20*c* of the purge conduit 20*a* may be closed by the check valve 25 positioned therein. Conversely, the second blow-by gas returning conduit 30*b* may be closed by the PCV valve 31 (the check valve) positioned therein.

Figure 3:
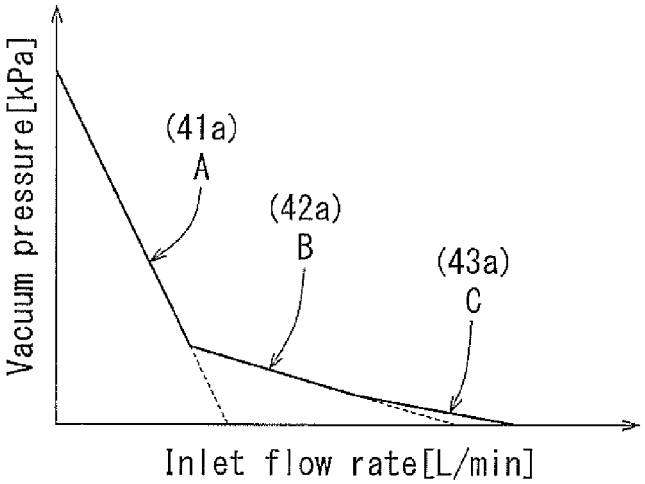
FIG. 3 is a graph illustrating an operating characteristic curve of the multi-stage ejector.

As shown in FIG. 3, which illustrates a relation between inlet flow rates and vacuum pressures (i.e., negative pressures) in the first to third inlet ports 41*a*, 42*a* and 43*a* of the multi-stage ejector 40, the multi-stage ejector 40 may have special operating characteristics. Further, in a graph shown in FIG. 3, a characteristic A (a portion shown by solid line and broken line), a characteristic B (a portion shown by solid line and broken line), and a characteristic C (a portion shown by solid line) may respectively correspond to the first to third inlet ports 41*a*, 42*a* and 43*a* of the multi-stage ejector 40. As will be apparent from the graph, in the first inlet port 41*a* (the characteristic A), the inlet flow rate may be relatively low while the vacuum pressure may be relatively high. In the second inlet port 42*a* (the characteristic B), the inlet flow rate may be relatively high while the vacuum pressure may be relatively low. Further, in the third inlet port 43*a* (the characteristic C), the inlet flow rate may be increased relative to the inlet flow rate in the second inlet port 42*a* while the vacuum pressure may be reduced relative to the vacuum pressure in the second inlet port 42*a*. This feature may be caused by the difference in the nozzle diameters of ejector elements 41, 42 and 43.

The purge conduit 20*a* may have a relatively higher pressure loss relative to the first blow-by gas returning conduit 30*a* because the purge conduit 20*a* may have a relatively higher conduit flow resistance caused by the canister 21, the purge valve 22 or other such devices disposed therein. However, as described above, in some embodiments the first conduit 20*b* of the purge conduit 20*a* is connected to the first inlet port 41*a* having the characteristic A (shown in FIG. 3) in which the inlet flow rate may be relatively low while the vacuum pressure (the negative pressure) may be relatively high. Therefore, the canister 21 may be reliably purged with limited influence of the pressure loss due to the high negative pressure in the first inlet port 41*a*. Conversely, in some embodiments the first blow-by gas returning conduit 30*a* is connected to the second inlet port 42*a* and the third inlet port 43*a* respectively having the characteristics B and C (shown in FIG. 3) in which the inlet flow rates may be relatively high while the vacuum pressures may be relatively low. Therefore, the blow-by gas accumulated within the crankcase of the engine 11 may be reliably returned to the combustion chambers of the engine 11 due to the high inlet flow rates in the second and third inlet ports 42*a* and 43*a* regardless of the relatively low negative pressures therein.

As described above, in this embodiment, a purge of the canister 21 and a return of the blow-by gas accumulated within the crankcase of the engine 11 may be performed by the (single) multi-stage ejector 40, i.e., the common ejector. That is, in certain embodiments the vaporized fuel treating device 20 and the blow-by gas returning device 30 include the multi-stage ejector 40 which may function as a common construction element thereof. Therefore, in some embodiments no special ejectors are required for the vaporized fuel treating device 20, and the blow-by gas returning device 30 in order to perform the purge of the canister 21 and the return of the blow-by gas accumulated within the crankcase of the engine 11. As a result, the engine system 10 including the vaporized fuel treating device 20 and the blow-by gas returning device 30 is thereby simplified.

Further, in some embodiments the purge valve 22 disposed in the purge conduit 20*a* is configured such that an opening degree thereof may be reduced or reduced to zero in order to restrict or stop the purge of the canister 21. When a flow rate of air flowing through the purge conduit 20*a* is reduced as a result of reduction of the opening degree of the purge valve 22, an amount of air introduced into the first inlet port 41*a* of the multi-stage ejector 40 may be reduced or reduced to zero in turn, so that an amount of air introduced into the second and third inlet ports 42*a* and 43*a* of the multi-stage ejector 40 can be increased for that amount. Therefore, when it is not needed to purge the canister 21, the multi-stage ejector 40 may be used exclusively to return the blow-by gas to the engine 11. As a result, the blow-by gas returning device 30 may have an increased blow-by gas returning performance.

Figure 4:
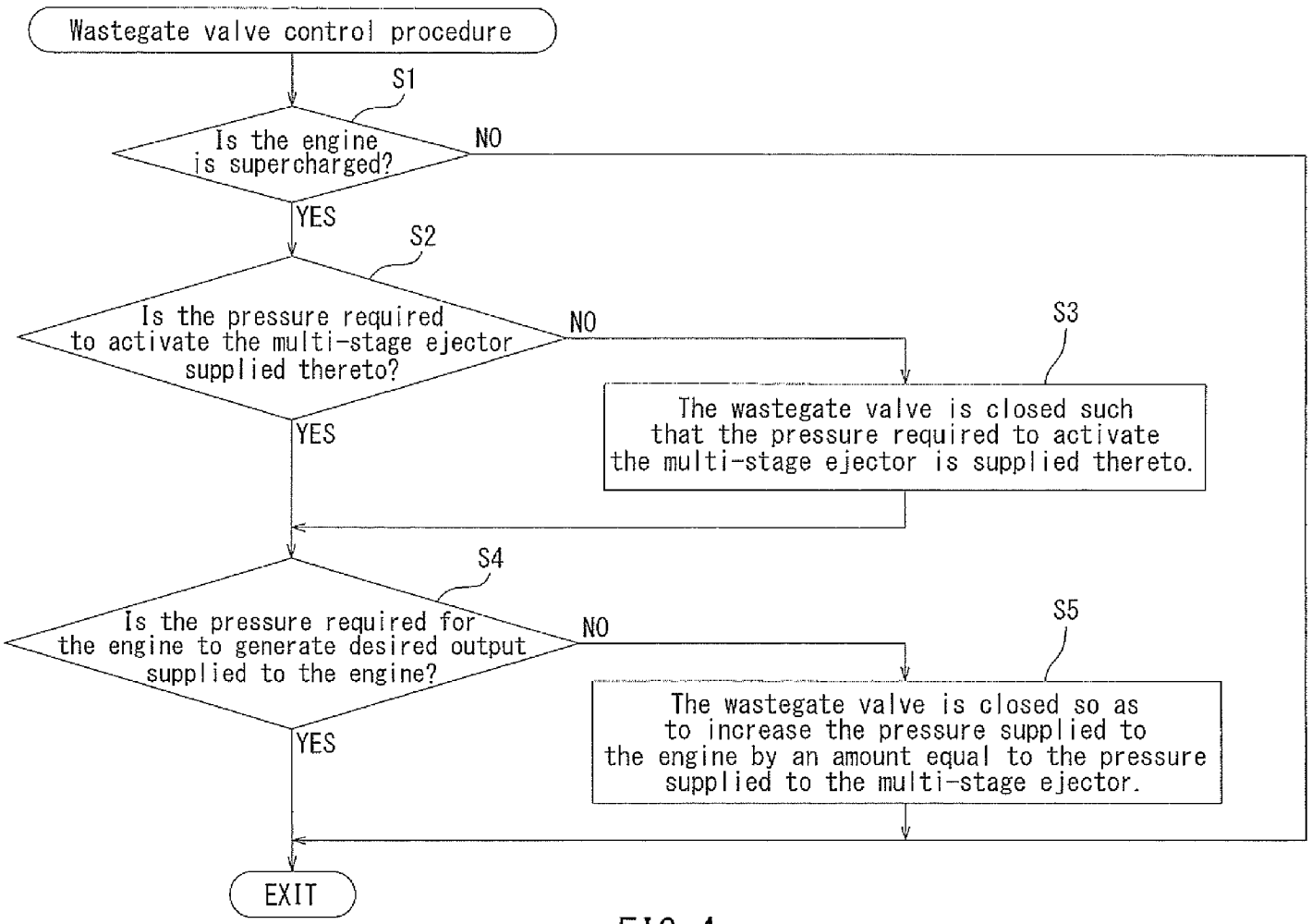
FIG. 4 is a flow chart of a control procedure (routine) of a wastegate valve of the engine system.
Figure 5:
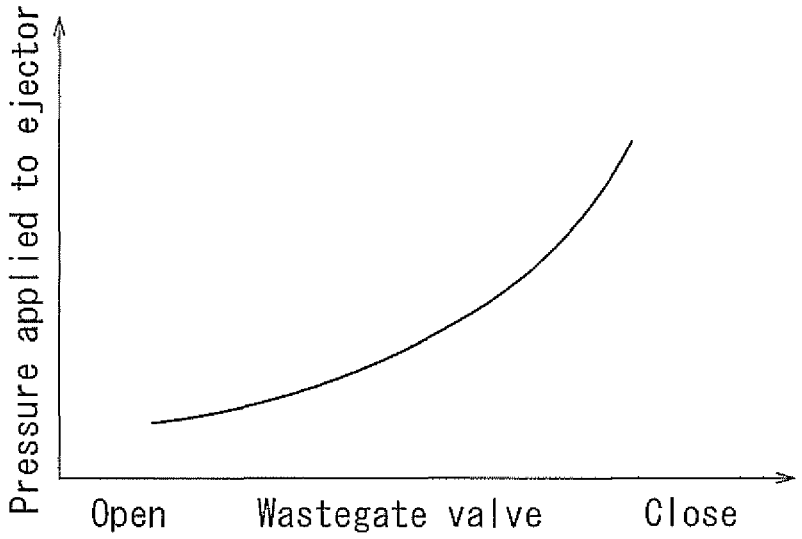
FIG. 5 is a graph illustrating a relation between an opening degree of the wastegate valve and a pressure applied to the multi-stage ejector.

Next, an embodiment of a control procedure (routine) of the wastegate valve 15 (the turbocharger 14) is described with reference to FIG. 4. As will be recognized, the control procedure of the wastegate valve 15 may be performed as a portion of a program that is executed by a computer contained in the ECU 18 (which may be referred to as a boost pressure control device) that is configured to control ignition timing of the engine 11, air-fuel ratio of the engine 11, fuel injection timing of the engine 11 or other such factors.

In some embodiments, execution of the program allows for a determination of whether the boost pressure generated by the turbocharger 14 reaches a predetermined pressure, or in other words, a determination of whether the engine 11 is supercharged by turbocharger 14 (Step S1). When the engine 11 is not supercharged (NO in Step S1), the procedure may be terminated. Contradistinctively, when the engine 11 is supercharged (YES in Step S1), a determination of whether a pressure required to activate the multi-stage ejector 40 is supplied to the multi-stage ejector 40 may be made based on the pressure detected by the first pressure sensor 51 (Step S2). In certain embodiments, when the detection pressure detected by the first pressure sensor 51 does not reach a first predetermined pressure (which may be referred to as a "predetermined pressure"), or in other words, when Step S2 is denoted by NO, the wastegate valve 15 is closed such that the pressure required to activate the multi-stage ejector 40 is supplied to the multi-stage ejector 40, i.e., such that the detection pressure detected by the first pressure sensor 51 equals or exceeds the first predetermined pressure (Step S3). As shown particularly in FIG. 5, when the wastegate valve 15 is closed, the pressure applied to the charge port 40*a* of the multi-stage ejector 40 is increased. In certain embodiments, step S3 is followed by Step S4. Contradistinctively, when the detection pressure detected by the first pressure sensor 51 equals or exceeds the first predetermined pressure (YES in Step S2), Step S2 may be followed by Step S4 without intervening Step S3.

In Step S4, in some embodiments a determination of whether a pressure required for the engine 11 to generate desired output is supplied to the engine 11 is based on the (boost) pressure detected by the second pressure sensor 52. When the detection pressure detected by the second pressure sensor 52 does not reach a second predetermined pressure (which may be referred to as a "pressure corresponding to an engine load"), or in other words, when Step S4 is denoted by NO, a determination that the pressure (amount of air) supplied to the engine 11 is insufficient in quantity by an amount equal to the pressure supplied to the multi-stage ejector 40 may be made, so that the wastegate valve 15 may be closed (Step S5). When the wastegate valve 15 is closed, the pressure in the intake conduit 17 positioned downstream of the throttle valve 13, as well as the pressure applied to the charge port 40*a* of the multi-stage ejector 40, may be increased, so that output of the engine 11 may be increased according to the engine load. Consequently, the procedure may be terminated. Contradistinctively, when the detection pressure detected by the second pressure sensor 52 equals or exceeds the second predetermined pressure (YES in Step S4), the procedure may be terminated without intervening Step S5.

In this embodiment, the multi-stage ejector 40 may be disposed in the bypass passage 46 connected to the intake conduit 17 and in fluid communication with the engine 11. Therefore, the boost pressure of the turbocharger 14 may be supplied to the multi-stage ejector 40 as well as the intake passage of the engine 11. However, in some embodiments an opening degree of the wastegate valve 15 is controlled such that the boost pressure supplied to the multi-stage ejector 40 equals or exceeds the first predetermined pressure required to activate the multi-stage ejector 40. Therefore, the boost pressure supplied to the multi-stage ejector 40 may be prevented from becoming insufficient in quantity. As a result, the purge of the canister 21 and the return of the blow-by gas may be appropriately performed via the negative pressure generated in the multi-stage ejector 40.

Further, the opening degree of the wastegate valve 15 may be controlled such that the boost pressure supplied to the intake passage of the engine 11 equals or exceeds the second predetermined pressure corresponding to the engine load. Therefore, the boost pressure supplied to the intake passage of the engine 11 may thereby be prevented from becoming insufficient in quantity. As a result, the output of the engine 11 according to the engine load may be ensured.

Figure 6:
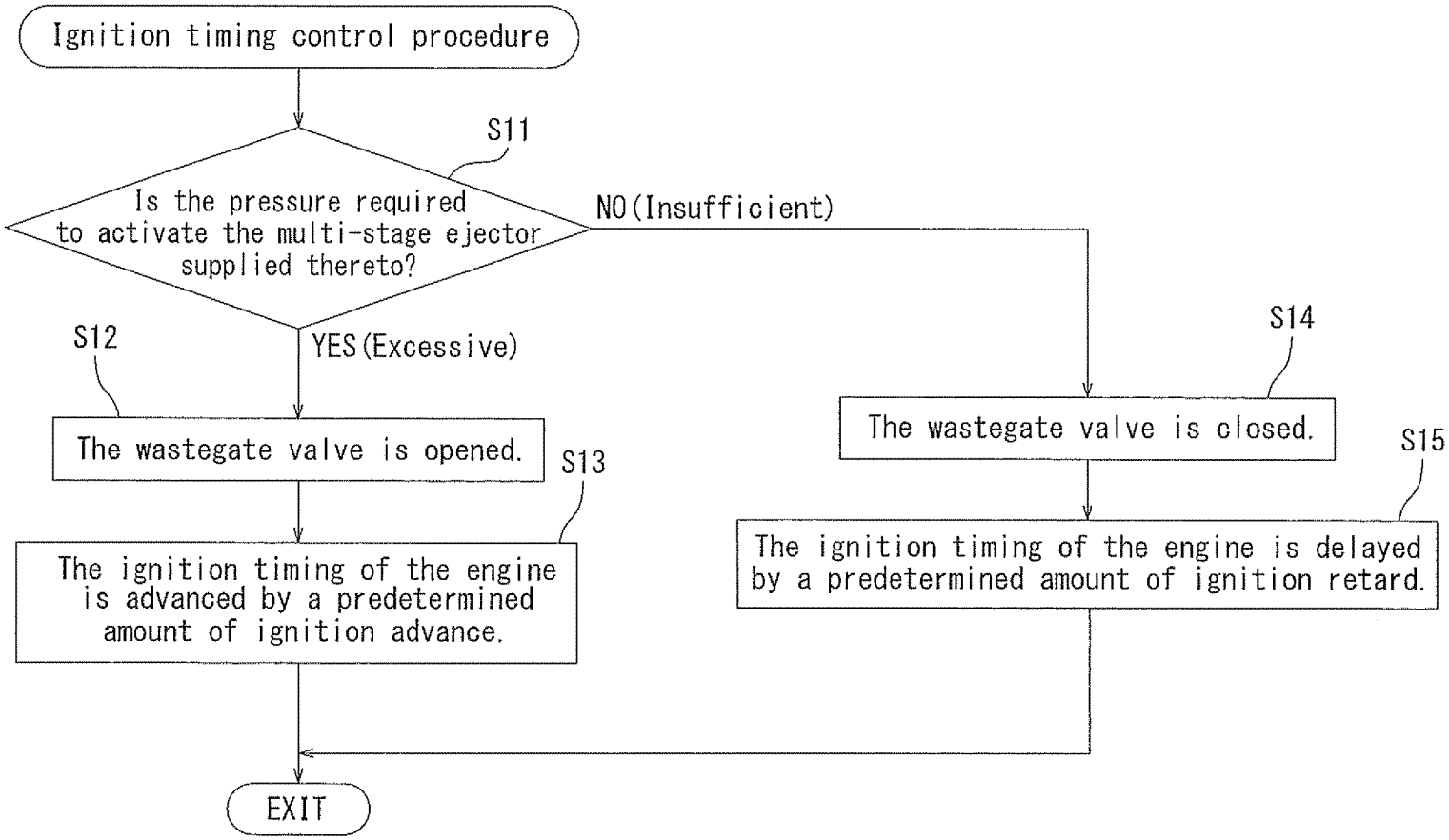
FIG. 6 is a flow chart of a control procedure (routine) of ignition timing of an engine according to a second embodiment of the present disclosure.

A second detailed representative embodiment of the present disclosure is described with reference to FIGS. 6 and 7.

Because the second embodiment relates to the first embodiment, only the constructions and elements that are different from the first embodiment will be explained in detail. In particular, this embodiment is different from the first embodiment in that the ECU 18 may be configured to reduce an output variation of the engine 11 that is caused by a control of the (boost) pressure supplied to the multi-stage ejector 40.

A control procedure (routine) of the ignition timing of the engine 11 to control the output variation of the engine 11 is described with reference to FIG. 6. The control procedure of the ignition timing of the engine 11 may be performed as a portion of the program that is executed by a computer contained in the ECU 18 (which may be referred to as an engine output control device) that is configured to control the ignition timing of the engine 11, the air-fuel ratio of the engine 11, the fuel injection timing of the engine 11 or other such factors.

Execution of the program may allow for a determination of whether the pressure required to activate the multi-stage ejector 40 is supplied to the multi-stage ejector 40 may be based on the pressure detected by the first pressure sensor 51 (Step S11). In some embodiments, when the detection pressure detected by the first pressure sensor 51 does not reach the first predetermined pressure, or in other words, when Step S11 is denoted by NO (insufficient), the wastegate valve 15 is closed such that the pressure required to activate the multi-stage ejector 40 is supplied to the multi-stage ejector 40, i.e., such that the detection pressure detected by the first pressure sensor 51 equals or exceeds the first predetermined pressure (Step S14). Thereafter, the ignition timing of the engine 11 may be delayed by a predetermined amount of ignition retard (Step S15). As a result, the output of the engine 11 may be reduced such that increases in output of the engine 11 caused by an increase of the pressure supplied to the intake passage may be adjusted or compensated. That is, when the pressure supplied to the multi-stage ejector 40 is increased, the pressure supplied to the intake passage of the engine 11 may be increased, so that the output of the engine 11 may be correspondingly increased. However, the increased output of the engine 11 can be reduced or compensated due to the ignition retard.

Contradistinctively, when the detection pressure detected by the first pressure sensor 51 equals or exceeds the first predetermined pressure, or in other words, when Step S11 is denoted by YES (excessive), the wastegate valve 15 may be opened such that the pressure supplied to the multi-stage ejector 40 is restricted or reduced, i.e., such that the detection pressure detected by the first pressure sensor 51 is lower than the first predetermined pressure (Step S12). Thereafter, the ignition timing of the engine 11 may be advanced by a predetermined amount of ignition advance (Step S13). As a result, the output of the engine 11 may be increased such that decreases in output of the engine 11 caused by a decrease of the pressure supplied to the intake passage may be adjusted or compensated. That is, when the pressure supplied to the multi-stage ejector 40 is decreased, the pressure supplied to the intake passage of the engine 11 may be reduced, so that the output of the engine 11 may be correspondingly reduced. However, the reduced output of the engine 11 can be increased or compensated due to the ignition advance.

Figure 7:
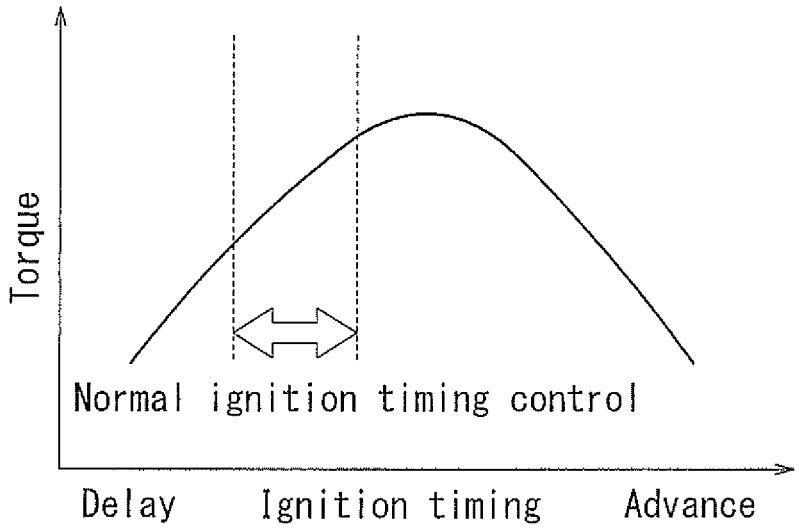
FIG. 7 is a graph illustrating a relation between the ignition timing of the engine and an output torque of the engine.

Further, as shown particularly in FIG. 7, when the ignition timing of the engine 11 may be controlled (delayed or advanced) within a normal ignition timing control range, the output of the engine 11 may be correspondingly controlled (reduced or increased). Further, in order to reduce the output variation of the engine 11, the air-fuel ratio of the engine 11 or the fuel injection timing of the engine 11 may be controlled instead of controlling the ignition timing of the engine 11.

Thus, according to the second embodiment, the output variation of the engine 11 caused by the control of the pressure supplied to the multi-stage ejector 40 may be reduced or controlled.

Figure 8:
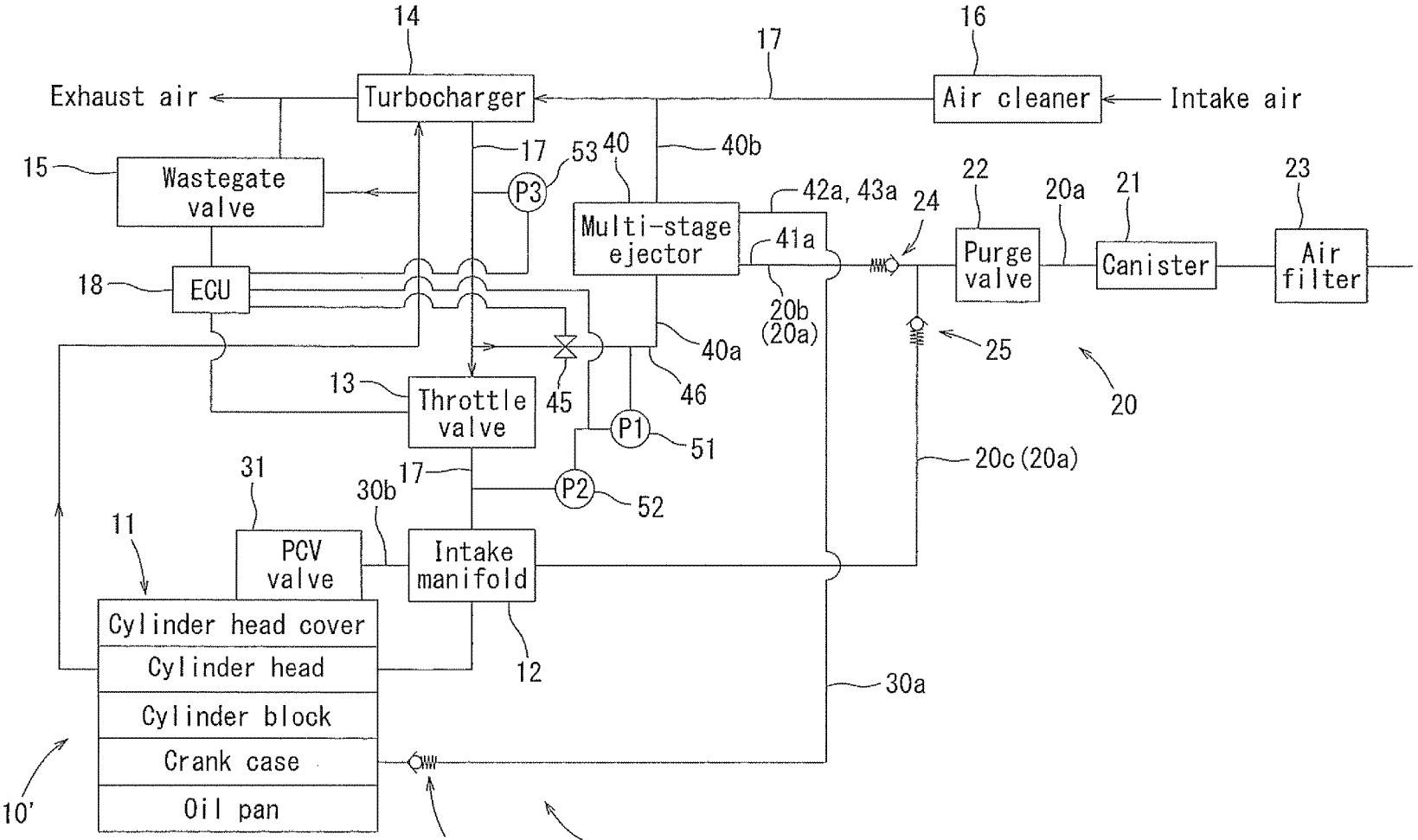
FIG. 8 is a block diagram of an engine system having a vaporized fuel treating device and a blow-by gas returning device according to a third embodiment of the present disclosure.
Figure 9:
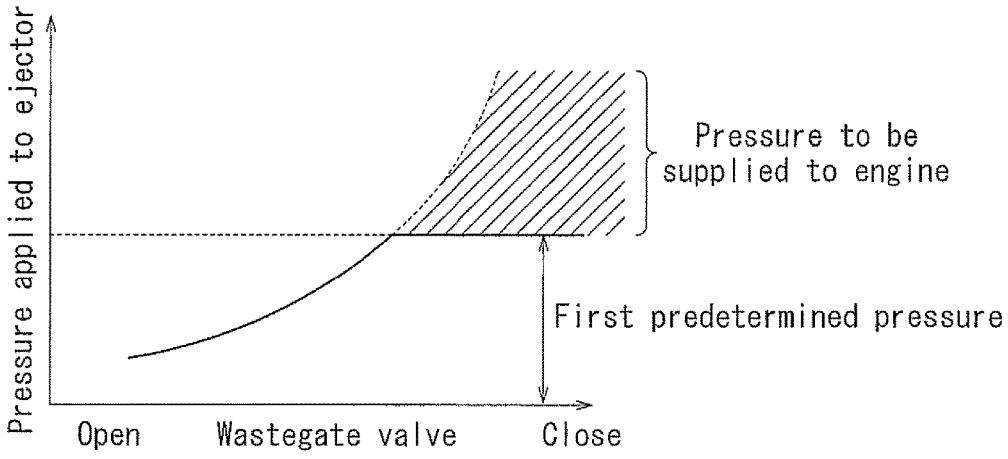
FIG. 9 is a graph illustrating a relation between an opening degree of the wastegate valve and a pressure applied to a multi-stage ejector.

A third detailed representative embodiment of the present disclosure is described with reference to FIGS. 8 and 9.

Because the third embodiment relates to the first and second embodiments, only the constructions and elements that are different from the first and second embodiments will be explained in detail. Elements that are the same in the first to third embodiments will be identified by the same reference numerals and a detailed description of such elements may be omitted.

This embodiment may be directed to an engine system 10' that is constructed as a modified form of the engine system 10 of the first and second embodiment. In some embodiments of the engine system 10', the bypass passage 46 includes a solenoid valve 45 (which may be referred to as an ejector control valve) instead of the check valve 44. Further, the intake conduit 17 may have a third pressure sensor 53 in addition to the first and second pressure sensors 51 and 52. The third pressure sensor 53 may be positioned between the turbocharger 14 and the throttle valve 13. The third pressure sensor 53 thus positioned may be configured to detect the pressure or boost pressure in the intake conduit 17 between the turbocharger 14 and the throttle valve 13 and to send a representative signal to the ECU 18. Further, in certain embodiments the solenoid valve 45 is in communication with the ECU 18 so that an opening degree thereof can be controlled based on the detection pressure detected by the third pressure sensor 53.

As described above, in the first and second embodiments, the wastegate valve 15 may be controlled based on the detection pressure detected by the first pressure sensor 51, so that the pressure supplied to the multi-stage ejector 40 may thereby be controlled. However, when the wastegate valve 15 is closed (i.e., when the boost pressure in the intake conduit 17 is increased), the pressure supplied to the multi-stage ejector 40 may be increased beyond the pressure required to activate the multi-stage ejector 40 because the boost pressure may be supplied to the multi-stage ejector 40 via the check valve 44, which cannot be controlled.

Conversely, in this embodiment, the boost pressure may be supplied to the multi-stage ejector 40 via the solenoid valve 45. That is, the pressure supplied to the multi-stage ejector 40 may be regulated by the solenoid valve 45. In some embodiments, the control of solenoid valve 45 is based on whether the detection pressure detected by the third pressure sensor 53 equals or exceeds the first predetermined pressure required to activate the multi-stage ejector 40. In particular, when the detection pressure detected by the third pressure sensor 53 does not reach the first predetermined pressure, the solenoid valve 45 may be fully opened such that the negative pressures may be generated in the multi-stage ejector 40. Conversely, when the detection pressure detected by the third pressure sensor 53 equals or exceeds the first predetermined pressure, the opening degree of the solenoid valve 45 may be controlled such that the first predetermined pressure may be supplied to the multi-stage ejector 40 (i.e., such that the detection pressure detected by the first pressure sensor 51 may equal the first predetermined pressure). Therefore, as shown in FIG. 9, when the wastegate valve 15 is closed, the pressure supplied to the multi-stage ejector 40 may be accurately controlled by the solenoid valve 45 so as to not exceed the first predetermined pressure (i.e., the pressure required to activate the multi-stage ejector 40). Thus, the pressure supplied to the multi-stage ejector 40 may be prevented from exceeding the first predetermined pressure via the control of the solenoid valve 45. Therefore, when the boost pressure is varied, as caused by the control of the wastegate valve 15, the boost pressure supplied to the multi-stage ejector 40 may be prevented from varying. Further, in some embodiments a pressure exceeding the first predetermined pressure may be supplied to the intake passage of the engine 11. Therefore, the boost pressure generated by the turbocharger 14 may be effectively used in order to increase the output of the engine 11.

In certain embodiments, the solenoid valve 45 is replaced with a diaphragm pressure control valve. Similar to the solenoid valve 45, the diaphragm pressure control valve may accurately control the boost pressure supplied to the multi-stage ejector 40 so as to prevent the pressure from increasing beyond the first predetermined pressure. Further, in other embodiments the solenoid valve 45 may be replaced with an electrically actuated opening control valve.

Naturally, various changes and modifications may be made to the engine systems 10 and 10' of the first to third embodiments. For example, the engine systems 10 and 10' may each have a mechanical supercharger other than the turbocharger 14, as described above. In the supercharger, a compressor may be driven via an output shaft of the engine 11. Therefore, a boost pressure generated by the compressor of the supercharger may be controlled by controlling a drive force transmitted to the compressor. Further, the multi-stage ejector 40 is not limited to the three-stage ejector. Also, in some embodiments the multi-stage ejector 40 may be replaced with a single-stage ejector. As will be recognized, when the single-stage ejector is used, both of the purge conduit 20*a* (the first conduit 20*b*) and the first blow-by gas returning conduit 30*a* may be coupled to a single inlet port of the single-stage ejector so as to be switched therebetween. Further, the embodiments may be applied to an engine system other than the engine systems 10 and 10' of the vehicle. Also, the embodiments may be applied to a hybrid engine system in which motors are used in addition to the engine.

Representative examples of the present disclosure have been described in detail with reference to the attached drawings. This detailed description is merely intended to teach a person of skill in the art further details for practicing preferred aspects of the present disclosure and is not intended to limit the scope of the disclosure. Only the claims define the scope of the claimed disclosure. Therefore, combinations of features and steps disclosed in the foregoing detail description may not be necessary to practice the disclosure in the broadest sense, and are instead taught merely to particularly describe detailed representative examples of the disclosure. Moreover, the various features taught in this specification may be combined in ways that are not specifically enumerated in order to obtain additional useful embodiments of the present disclosure.

What is claimed is:

1. A combination of a vaporized fuel treating device and a blow-by gas returning device for an engine having a forced induction device, comprising:

an ejector;

wherein the forced induction device is disposed in an intake conduit;

wherein the ejector is disposed in a bypass passage that is in communication with the intake conduit at a first location upstream from the forced induction device and a second location downstream from the forced induction device;

wherein the vaporized fuel treating device is configured to adsorb vaporized fuel from a fuel tank to a canister through a vapor conduit and to feed the adsorbed vaporized fuel to the engine through a purge conduit so as to purge the adsorbed vaporized fuel from the canister;

wherein the blow-by gas returning device is configured to return gas leaked from combustion chambers of the engine to the intake conduit through a blow-by gas returning conduit that is in communication with the ejector, so as to return the gas to the combustion chambers of the engine;

wherein the ejector is configured to receive a boost gas generated by the forced induction device and to generate negative pressures therein, so as to supply the generated negative pressures to the purge conduit and the blow-by gas returning conduit;

further comprising an ejector control valve disposed in the bypass passage and configured to control a boost pressure supplied to the ejector so as to not exceed the pressure required to activate the ejector.

2. The combination of a vaporized fuel treating device and a blow-by gas returning device for an engine having a forced induction device of claim 1, wherein the ejector comprises a multi-stage ejector having a plurality of inlet ports in which the negative pressures are generated, wherein a first inlet port of the multi-stage ejector in which a relatively high negative pressure is generated is connected to the purge conduit, and wherein a second inlet port of the multi-stage ejector in which a relatively low negative pressure is generated is connected to the blow-by gas returning conduit.

3. The combination of a vaporized fuel treating device and a blow-by gas returning device for an engine having a forced induction device of claim 1, wherein the purge conduit comprises a purge control valve that is configured to control a flow rate of air flowing through the purge conduit.

4. The combination of a vaporized fuel treating device and a blow-by gas returning device for an engine having a forced induction device of claim 1, further comprising a boost pressure control device that is configured to control the forced induction device such that the boost pressure supplied to the ejector equals or exceeds a pressure required to activate the ejector.

5. The combination of a vaporized fuel treating device and a blow-by gas returning device for an engine having a forced induction device of claim 1, further comprising a boost pressure control device that is configured to control the forced induction device such that the boost pressure in the intake conduit equals or exceeds a pressure corresponding to a load of the engine.

6. The combination of a vaporized fuel treating device and a blow-by gas returning device for an engine having a forced induction device of claim 4, further comprising an engine output control device that is configured to reduce a variation in output of the engine that is caused by a control of the forced induction device by the boost pressure control device.

7. The combination of a vaporized fuel treating device and a blow-by gas returning device for an engine having a forced induction device of claim 4, further comprising a pressure sensor disposed in the bypass passage, wherein the boost pressure control device is configured to control the forced induction device based on a pressure detected by the pressure sensor.

8. A combination of a vaporized fuel treating device and a blow-by gas returning device for an engine having a forced induction device, comprising:

an ejector;

wherein the forced induction device is disposed in an intake conduit;

wherein the ejector is disposed in a bypass passage that is in communication with the intake conduit at a first location upstream from the forced induction device and a second location downstream from the forced induction device;

wherein the ejector has a first inlet port and a second inlet port;

wherein the first inlet port and the second inlet port are respectively in communication with a purge conduit of the vaporized fuel treating device and a blow-by gas returning conduit of the blow-by gas returning device; and further comprising an ejector control valve disposed in the bypass passage and configured to control a boost pressure supplied to the ejector so as to not exceed the pressure required to activate the ejector.

9. The combination of a vaporized fuel treating device and a blow-by gas returning device for an engine having a forced induction device of claim 1, wherein the bypass passage is in communication with the intake conduit at a portion positioned on an upstream side of the forced induction device and a portion positioned between the forced induction device and a throttle valve.

10. A combination of a vaporized fuel treating device and a blow-by gas returning device for an engine having a forced induction device, comprising:

an ejector;

wherein the forced induction device is disposed in an intake conduit;

wherein the ejector is disposed in a bypass passage that is in communication with the intake conduit at a first location upstream from the forced induction device and a second location downstream from the forced induction device;

wherein the vaporized fuel treating device is configured to adsorb vaporized fuel from a fuel tank to a canister through a vapor conduit and to feed the adsorbed vaporized fuel to the engine through a purge conduit so as to purge the adsorbed vaporized fuel from the canister;

wherein the blow-by gas returning device is configured to return gas leaked from combustion chambers of the engine to the intake conduit through a blow-by gas returning conduit that is in communication with the ejector, so as to return the gas to the combustion chambers of the engine;

wherein the ejector is configured to receive a boost gas generated by the forced induction device and to generate negative pressures therein, so as to supply the generated negative pressures to the purge conduit and the blow-by gas returning conduit;

further comprising at least one check valve disposed in the bypass passage and configured to allow a flow of air from a downstream side to an upstream side of the forced induction device and to prevent a reverse flow therebetween.

11. The combination of a vaporized fuel treating device and a blow-by gas returning device for an engine having a forced induction device of claim 10, wherein the bypass passage is in communication with the intake conduit at a portion positioned on an upstream side of the forced induction device and a portion positioned between the forced induction device and a throttle valve.

12. The combination of a vaporized fuel treating device and a blow-by gas returning device for an engine having a forced induction device of claim 10, wherein the at least one check valve is configured to keep a boost pressure in an upstream side of the ejector above a boost pressure in a downstream side of the ejector.

13. The combination of a vaporized fuel treating device and a blow-by gas returning device for an engine having a forced induction device of claim 10, wherein the at least one check valve is positioned on an upstream side of the ejector.

14. The combination of a vaporized fuel treating device and a blow-by gas returning device for an engine having a forced induction device of claim 10, wherein the at least one check valve comprises a single check valve.

15. A combination of a vaporized fuel treating device and a blow-by gas returning device for an engine having a forced induction device, comprising:

an ejector;

wherein the forced induction device is disposed in an intake conduit;

wherein the ejector is disposed in a bypass passage that is in communication with the intake conduit at a first location upstream from the forced induction device and a second location downstream from the forced induction device;

wherein the ejector has a first inlet port and a second inlet port; and wherein the first inlet port and the second inlet port are respectively in communication with a purge conduit of the vaporized fuel treating device and a blow-by gas returning conduit of the blow-by gas returning device;

further comprising a check valve disposed in the bypass passage and configured to allow a flow of air from a downstream side to an upstream side of the forced induction device and to prevent a reverse flow therebetween.

16. A combination of a vaporized fuel treating device and a blow-by gas returning device for an engine having a forced induction device, comprising:

an ejector;

wherein the forced induction device is disposed in an intake conduit;

wherein the ejector is disposed in a bypass passage that is in communication with the intake conduit at a first location upstream from the forced induction device and a second location downstream from the forced induction device;

wherein the vaporized fuel treating device is configured to adsorb vaporized fuel from a fuel tank to a canister through a vapor conduit and to feed the adsorbed vaporized fuel to the engine through a purge conduit so as to purge the adsorbed vaporized fuel from the canister;

wherein the blow-by gas returning device is configured to return gas leaked from combustion chambers of the engine to the intake conduit through a blow-by gas returning conduit that is in communication with the ejector, so as to return the gas to the combustion chambers of the engine;

wherein the ejector is configured to receive a boost gas generated by the forced induction device and to generate negative pressures therein, so as to supply the generated negative pressures to the purge conduit and the blow-by gas returning conduit; and further comprising at least one check valve disposed in the bypass passage and configured to keep a boost pressure in an upstream side of the ejector above a boost pressure in a downstream side of the ejector.

17. The combination of a vaporized fuel treating device and a blow-by gas returning device for an engine having a forced induction device of claim 16, wherein the bypass passage is in communication with the intake conduit at a portion positioned on an upstream side of the forced induction device and a portion positioned between the forced induction device and a throttle valve.

18. The combination of a vaporized fuel treating device and a blow-by gas returning device for an engine having a forced induction device of claim 16, wherein the at least one check valve is positioned on the upstream side of the ejector.

19. The combination of a vaporized fuel treating device and a blow-by gas returning device for an engine having a forced induction device of claim 16, wherein the at least one check valve comprises a single check valve.

* * * * *